United States Patent [19]

Leatherman

[11] Patent Number: 4,927,802

[45] Date of Patent: May 22, 1990

[54] PRESSURE-SENSITIVE MULTI-PART RECORD UNIT

[75] Inventor: Dennis D. Leatherman, Pittsburgh, Pa.

[73] Assignee: PPG Industries, Inc., Pittsburgh, Pa.

[21] Appl. No.: 282,429

[22] Filed: Dec. 9, 1988

[51] Int. Cl.[5] ..... B41M 5/22

[52] U.S. Cl. ..... 503/214; 428/321.3; 428/331; 428/914; 503/219; 503/225; 503/226

[58] Field of Search ..... 427/150–152; 428/331, 913, 914, 321.3; 503/216, 225, 226, 200, 217, 214, 215, 218, 219

[56] References Cited

U.S. PATENT DOCUMENTS

| | | | |
|---|---|---|---|
| Re. 23,024 | 8/1948 | Adams | 260/344.6 |
| Re. 24,899 | 11/1960 | Green | 252/316 |
| Re. 31,412 | 10/1983 | Hatano et al. | 428/537 |
| 2,068,204 | 1/1937 | Smith | 134/32 |
| 2,299,694 | 10/1942 | Green | 106/236 |
| 2,374,862 | 5/1945 | Green | 106/137 |
| 2,505,470 | 4/1950 | Green | 117/36 |
| 2,505,472 | 4/1950 | Green | 117/36 |
| 2,505,480 | 4/1950 | Green | 117/36 |
| 2,548,364 | 4/1951 | Green et al. | 282/28 |
| 2,548,365 | 4/1951 | Green et al. | 117/36 |
| 2,550,466 | 4/1951 | Green et al. | 282/28 |
| 2,550,467 | 4/1951 | Green et al. | 282/28 |
| 2,550,468 | 4/1951 | Green et al. | 282/28 |
| 2,550,469 | 4/1951 | Green et al. | 282/28 |
| 2,550,470 | 4/1951 | Green et al. | 282/28 |
| 2,550,471 | 4/1951 | Green et al. | 282/28 |
| 2,550,472 | 4/1951 | Green et al. | 282/28 |
| 2,550,473 | 4/1951 | Green et al. | 282/28 |
| 2,712,507 | 7/1955 | Green | 117/36 |
| 2,714,074 | 7/1955 | Green | 117/45 |
| 2,730,456 | 1/1956 | Green et al. | 117/36 |
| 2,730,457 | 1/1956 | Green et al. | 117/36 |
| 2,772,322 | 11/1956 | Witt et al. | 136/146 |
| 2,800,457 | 7/1957 | Green et al. | 252/316 |
| 2,800,458 | 7/1957 | Green | 252/316 |
| 2,828,341 | 3/1958 | Adams et al. | 260/570 |
| 2,828,342 | 3/1958 | Adams et al. | 260/570 |
| 2,940,830 | 6/1960 | Thornhill | 23/182 |
| 2,981,733 | 4/1961 | Kranz | 260/247.5 |
| 2,981,738 | 4/1961 | Kranz | 260/308 |
| 3,351,495 | 11/1967 | Larsen et al. | 136/146 |
| 3,455,721 | 7/1969 | Phillips et al. | 117/36.2 |
| 3,466,184 | 9/1969 | Miller | 117/36.2 |
| 3,672,935 | 6/1972 | Miller et al. | 117/36.8 |
| 3,696,061 | 10/1972 | Selsor et al. | 260/2.5 M |
| 3,725,520 | 4/1973 | Suzuki et al. | 264/41 |
| 3,755,190 | 8/1973 | Hart et al. | 252/316 |
| 3,796,669 | 3/1974 | Kiritani et al. | 252/316 |
| 3,862,030 | 1/1975 | Goldberg | 210/24 |
| 3,875,074 | 4/1975 | Vassiliades et al. | 252/316 |
| 3,903,234 | 9/1975 | Ikeda et al. | 264/210 R |
| 3,914,511 | 10/1975 | Vassiliades | 428/411 |
| 3,920,510 | 11/1975 | Hatano et al. | 162/162 |
| 3,967,978 | 7/1976 | Honda et al. | 136/146 |
| 4,001,140 | 1/1977 | Foris et al. | 252/316 |
| 4,024,323 | 5/1977 | Versteegh | 429/249 |
| 4,025,455 | 5/1977 | Shackle | 252/316 |
| 4,025,490 | 5/1977 | Weaver | 260/53 R |
| 4,063,754 | 12/1977 | Shackle et al. | 282/27.5 |
| 4,087,376 | 5/1978 | Foris et al. | 252/316 |
| 4,089,547 | 5/1978 | Brynko et al. | 282/27.5 |
| 4,089,802 | 5/1978 | Foris et al. | 252/316 |
| 4,091,122 | 5/1978 | Davis et al. | 417/44 |
| 4,097,619 | 6/1978 | Davis et al. | 427/44 |
| 4,102,746 | 7/1978 | Goldberg | 195/63 |
| 4,112,138 | 9/1978 | Davis et al. | 427/54 |
| 4,137,084 | 1/1979 | Davis et al. | 106/21 |
| 4,154,462 | 5/1979 | Golden et al. | 282/27.5 |
| 4,169,014 | 9/1979 | Goldberg | 435/182 |
| 4,203,619 | 5/1980 | Sanders | 282/27.5 |
| 4,210,709 | 7/1980 | Doi et al. | 429/250 |
| 4,226,926 | 10/1980 | Goldberg et al. | 429/252 |
| 4,237,083 | 12/1980 | Young et al. | 264/41 |
| 4,264,365 | 4/1981 | Sanders | 106/21 |
| 4,268,069 | 5/1981 | Stolfo | 282/27.5 |
| 4,335,193 | 6/1982 | Doi et al. | 429/251 |
| 4,336,067 | 6/1982 | Shackle et al. | 106/21 |
| 4,350,655 | 9/1982 | Hoge | 264/145 |
| 4,398,954 | 8/1983 | Stolfo | 106/21 |
| 4,399,209 | 8/1983 | Sanders et al. | 430/138 |
| 4,472,328 | 9/1984 | Sugimoto et al. | 264/41 |
| 4,508,807 | 4/1985 | Adair | 430/138 |
| 4,532,200 | 7/1985 | Arney et al. | 430/138 |
| 4,551,407 | 11/1985 | Sanders et al. | 430/138 |
| 4,562,137 | 12/1985 | Sanders | 430/138 |
| 4,585,604 | 4/1986 | Okuyama et al. | 264/41 |
| 4,613,643 | 9/1986 | Nakamura et al. | 524/426 |
| 4,648,417 | 3/1987 | Johnson et al. | 134/105 |
| 4,681,750 | 7/1987 | Johnson et al. | 423/339 |
| 4,734,229 | 3/1988 | Johnson et al. | 264/40.6 |
| 4,791,144 | 12/1988 | Nagou et al. | 521/90 |
| 4,816,644 | 8/1989 | Young et al. | 428/195 |
| 4,833,172 | 5/1989 | Schwarz et al. | 521/62 |

OTHER PUBLICATIONS

*Encyclopedia of Polymer Science and Engineering*, vol. 9, John Wiley & Sons, Inc., pp. 724–745 (1987).

*Primary Examiner*—Bruce H. Hess
*Attorney, Agent, or Firm*—George D. Morris

[57] ABSTRACT

The front side of at least one receptor sheet of a pressure-sensitive multi-part record unit comprises microporous material comprising a matrix consisting essentially of substantially water-insoluble thermoplastic organic polymer, a large proportion of finely divided, water-insoluble siliceous particles, and interconnecting pores.

16 Claims, No Drawings

PRESSURE-SENSITIVE MULTI-PART RECORD UNIT

BACKGROUND OF THE INVENTION

Pressure-sensitive multi-part record units of the carbonless type are well known. Carbonless record units comprise at least one transfer sheet and at least one receptor sheet. The transfer sheet is a substrate, usually paper, coated on the back side with a pressure-rupturable coating having entrapped therein a profuse number of minute liquid droplets comprising at least one leuco dye dissolved in solvent, or a layer of pressure-rupturable microcapsules containing at least one leuco dye dissolved in solvent. In the case of pressure-rupturable microcapsules, the coating usually also includes larger inert particles such as starch, which protect the microcapsules from premature rupture during production of the record unit and normal handling. The receptor sheet is a substrate, usually paper, coated on the front side with a substance having acidic sites. When an impression, such as that provided by a pen, pencil, stylus, typewriter, dot-matrix printer, or daisy-wheel printer, is made on the front side of the transfer sheet, the pressure-rupturable coating or the pressure-rupturable microcapsules on the back side under the region of the impression rupture whereupon the dye solution is released and transferred to the underlying coating on the front side of the receptor sheet. The dye then reacts with the substance having acidic sites to form a color, thereby giving an image and forming a copy of the impression. More than one copy may be made simultaneously if the record unit includes one or more intermediate sheets, usually paper, coated on the front side in the manner of the receptor sheet and coated on the back side in the manner of the transfer sheet. These intermediate sheets therefore function both as receptor sheets and as transfer sheets. By custom, the first transfer sheet is referred to as a CB (coated back) sheet, the last receptor sheet if referred to as a CF (coated front) sheet, the dual coated intermediate sheets are referred to as CFB (coated frong and back) sheets, the coating on the back of a CB sheet or a CFB sheet is referred to as a CB coating, and the coating on the front of a CF sheet or a CFB sheet is referred to as a CF coating.

It will be apparent that some or all intermediate sheets need not be CFB sheets. When desired, one or more pairs of a CB sheet overlying a CF sheet may be used as intermediate sheets. Although not common, one or more intermediate sheets may be neither CB, CF, nor CFB sheets. These may be removed prior to application of an impression or they may be allowed to remain, in which case they serve to convey impression pressure to lower sheets.

Receptor sheets (including CF and CFB sheets) based on CF coatings are not altogether satisfactory due to their limited durability upon long term or repeated exposures to water which attacks the paper substrates and/or the CF coatings. Waterproof materials such as films or sheets of thermoplastic organic polymers may be used as substrates, but the adhesion of CF coatings to these materials is often low.

THE INVENTION

It has now been discovered that the CF coating may be omitted if the front side of the receptor sheet comprises microporous material containing a large proportion of siliceaous particles.

Accordingly, in a pressure-sensitive multi-part record unit comprising: (a) at least one transfer sheet having a front side and a back side, the back side comprising (1) a pressure-rupturable coating having entrapped therein a profuse number of minute liquid droplets comprising at least one leuco dye dissolved in solvent, (2) pressure-rupturable microcapsules containing at least one leuco dye dissolved in solvent, or (3) a combination thereof, wherein the leuco dye is reactive with finely divided, substantially water-insoluble siliceous particles upon contact therewith to form a color, and (b) at least one receptor sheet having a front side and a back side, the front side of the receptor sheet comprising the siliceous particles, the invention is the improvement wherein the front side of the receptor sheet comprises microporous material comprising: (c) a matrix consisting essentially of substantially water-insoluble thermoplastic organic polymer, (d) finely divided substantially water-insoluble filler particles, of which at least about 50 percet by weight are siliceous particles with which the leuco dye is reactive upon contact to form a color, the filler particles being distributed throughout the matrix and constituting from about 50 percent to about 90 percent by weight of the microporous material, and (e) a network of interconnecting pores communicating substantially throughout the microporous material, the pores on a coating-free and impregnant-free basis constituting at least about 35 percent by volume of the microporous material.

The receptor sheet may or may not have a CB coating, as desired. It may be a laminate with the microporous material bonded to a substrate or, as is preferred, the microporous material may constitute the substantial entirety of the material providing structural integrity to the receptor sheet.

Many known microporous materials may be employed as the receptor sheet in the present invention. Examples of such microporous materials are described in U.S. Pat. Nos. 2,772,322; 3,351,495; 3,696,061; 3,725,520; 3,862,030; 3,903,234; 3,967,978; 4,024,323; 4,102,746; 4,169,014; 4,210,709; 4,226,926; 4,237,083; 4,335,193; 4,350,655; 4,472,328; 4,585,604; 4,613,643; and 4,681,750, the disclosures of which are, in their entireties, incorporated herein by reference.

The matrix of the microporous material consists essentially of substantially water-insoluble thermoplastic organic polymer. The numbers and kinds of such polymers suitable for use as the matrix are enormous. In general, substantially any substantially water-insoluble thermoplastic oganis polymer which can be extruded, calendered, pressed, or rolled into film, sheet, strip, or web may be used. The polymer may be a single polymer or it may be a mixture of polymers. The polymers may be homopolymers, copolymers, random copolymers, block copolymers, graft copolymers, atactic polymers, isotactic polymers, syndiotactic polymers, linear polymers, or branched polymers. When mixtures of polymers are used, the mixture may be homogeneous or it may comprise two or more polymeric phases. Examples of classes of suitable substantially water-insoluble thermoplastic organic polymers include the thermoplastic polyolefins, poly(halo-substituted olefins), polyesters, polyamides, polyurethanes, polyureas, poly(vinyl halides), poly(vinylidene halides), polystyrenes, poly(vinyl esters), polycarbonates, polyethers, polysulfides, polyimides, polysilanes, polysiloxanes, polycaprolactones, polyacrylates, and polymethacrylates. Hybrid classes exemplified by the thermoplastic poly(urethane-ureas), poly(ester-amides), poly(silane-siloxanes), and poly(ether-esters) are within contemplation. Examples of suitable substantially water-insoluble thermoplastic organic polymers include thermoplastic high density polyethylene, low density polyethylene, ultrahigh molecular weight polyethylene, polypropylene (atactic, isotactic, or syndiotatic as the case may be), poly(vinyl chloride), polytetrafluoroethylene, copolymers of ethylene and acrylic acid, copolymers of ethylene and methacrylic acid, poly(vinylidene chloride), copolymers of vinylidene chloride and vinyl acetate, copolymers of vinylidene chloride and vinyl chloride, copolymers of ethylene and propylene, copolymers of ethylene and butene, poly(vinyl acetate), polystyrene, poly(omega-aminoundecanoic acid), poly(hexamethylene dipamide), poly(epsilon-caprolactam), and poly(-methyl methacrylate). These listings are by no means exhaustive, but are intended for purposes of illustration. The preferred substantially water-insoluble thermoplastic organic polymers comprise poly(vinyl chloride), copolymer of vinyl chloride, or mixtures thereof; or they comprise essentially linear ultrahigh molecular weight polyolefin which is essentially linear ultrahigh molecular weight polyethylene having an intrinsic viscosity of at least about 18 deciliters/gram, essentially linear ultrahigh molecular weight polypropylene having an intrinsic viscosity of at least about 6 deciliters/-gram, or a mixture thereof. Essentially linear ultrahigh molecular weight polyethylene having an intrinsic viscosity of at least about 18 deciliters/gram is especially preferred.

Inasmuch as ultrahigh molecular weight (UHMW) polyolefin is not a thermoset polymer having an infinite molecular weight, it is technically classified as a thermoplastic. However, because the molecules are essentially very long chains, UHMW polyolefin, and especially UHMW polyethylene, softens when heated but does not flow as a molten liquid in a normal thermoplastic manner. The very long chains and the peculiar properties they provide to UHMW polyolefin are believed to contribute in large measure to the desirable properties of microporous materials made using this polymer.

As indicated earlier, the intrinsic viscosity of the UHMW polyethylene is at least about 18 deciliters/-gram. In many cases the intrinsic viscosity is at least about 19 deciliters/gram. Although there is no particular restriction on the upper limit of the intrinsic viscosity, the intrinsic viscosity is frequently in the range of from about 18 to about 39 deciliters/gram. An intrinsic viscosity in the range of from about 18 to about 32 deciliters/gram is preferred.

Also as indicated earlier the intrinsic viscosity of the UHMW polypropylene is at least about 6 deciliters/-gram. In many cases the intrinsic viscosity is at least about 7 deciliters/gram. Although there is no particular restriction on the upper limit of the intrinsic viscosity, the intrinsic viscosity is often in the range of from about 6 to about 18 deciliters/gram. An intrinsic viscosity in the range of from about 7 to about 16 deciliters/gram is preferred.

As used herein and in the claims, intrinsic viscosity is determined by extrapolating to zero concentration the reduced viscosities or the inherent viscosities of several dilute solutions of the UHMW polyolefin where the solvent is freshly distilled decahydronaphthalene to which 0.2 percent by weight, 3,5-di-tert-butyl-4-hydroxyhydrocinnamic acid, neopentanetetrayl ester [CAS Registry No. 6683-19-8] has been added. The reduced viscosities or the inherent viscosities of the UHMW polyolefin are ascertained from relative viscosities obtained at 135° C. using an Ubbelohde No. 1 viscometer in accordance with the general procedures of ASTM D 4020-81, except that several dilute solutions of differing concentration are employed. ASTM D 4020-81 is, in its entirety, incorporated herein by reference.

The nominal molecular weight of UHMW polyethylene is empirically related to the intrinsic viscosity of the polymer according to the equation:

$$M=5.37\times10^4\,[\eta]^{1.37}$$

where M is the nominal molecular weight and $[\eta]$ is the intrinsic viscosity of the UHMW polyethylene expressed in deciliters/gram. Similarly, the nominal molecular weight of UHWM polyproplene is empirically related to the intrinsic viscosity of the polymer according to the equation:

$$M=8.88\times10^4\,[\eta]^{1.25}$$

where M is the nominal molecular weight and $[\eta]$ is the intrinsic viscosity of the UHMW polypropylene expressed in deciliters/gram.

The essentially linear ultrahigh molecular weight polypropylene is most frequently essentially linear ultrahigh molecular weight isotactic polypropylene. Often the degree of isotacicity of such polymer is at least about 95 percent, while preferably it is at least about 98 percent.

When used, sufficient UHMW polyolefin should be present in the matrix to provide its properties to the microporous material. Other thermoplastic organic polymer may also be present in the matrix so long as its presence does not materially affect the properties of the microporous material in an adverse manner. The amount of the other theromplastic polymer which may be present depends upon the nature of such polymer. In general, a greater amount of other thermoplastic organic polymer may be used if the molecular structure contains little branching, few long sidechains, and few bulky side groups, than when there is a large amount of branching, many lone sidechains, or many bulky side groups. For this reason, the preferred thermoplastic organic polymers which may optionally be present are low density polyethylene, high density polyethylene, poly(tetrafluoroethylene), polypropylene, copolymers of ethylene and propylene, copolymers of ethylene and acrylic acid, and copolymers of ethylene and methacrylic acid. If desired, all or a portion of the carboxyl groups of carboxyl-containing copolymers may be neutralized with sodium, zinc, or the like. It is may experience that usually at least about 50 percent UHMW polyolefin, based on the weight of the matrix, will provide the desired properties to the microporous material. Often at least about 70 percent by weight of the matrix is UHMW polyolefin. In many cases the other thermoplastic organic polymer is substantially absent.

As present in the microporous material, the finely divided substantially water-insoluble siliceous particles may be in the form of ultimate particles, aggregaes of ultimate particles, or a combination of both. In most cases, at least about 90 percent by weight of the siliceous particles used in preparing the microporous material have gross particle sizes in the ranges of from about 5 to about 40 micrometers as determined by use of a Model TAII Coulter counter (Coutler Electronics, Inc.) according to ASTM C 690-80 but modified by stirring the filler for 10 minutes in Isoton II electrolyte (Curtin Matheson Scientific, Inc.) using a four-blade, 4.445 centimeter diameter propeller stirrer. Preferably at least about 90 percent by weight of the siliceous particles have gross particle sizes in the range of from about 10 to 30 micrometers. It is expected that the sizes of filler agglomerates may be reduced during processing of the ingredients to prepare the microporous material. Accordingly, the distribution of gross particle sizes in the microporous material may be smaller than in the raw siliceous filler itself. ASTM C 690-80 is, in its entirety, incorporated herein by reference.

Examples of suitable siliceous particles include particles of silica, mica, montmorillonite, kaolinite, asbestos, talc, diatomaceous earth, vermiculite, natural and synthetic zeolites, cement, calcium silicate, aluminum silicate, sodium aluminum silicate, aluminum polysilicate, alumina silica gels, and glass particles. Silica and the clays are the preferred siliceous particles. Of the silicas, precipitated silica, silica gel, or fumed silica is most often used.

In addition to the siliceous particles, finely divided substantially water-insoluble non-siliceous filler particles may also be employed. Examples of such optional non-siliceous filler particles include particles of carbon black, charcoal, graphite, titanium oxide, iron oxide, copper oxide, zinc oxide, antimony oxide, zirconia, magnesia, alumina, molybdenum disulfide, zinc sulfide, barium sulfate, strontium sulfate, calcium carbonate, magnesium carbonate, magnesium hydroxide, and finely divided substantially water-insoluble flame retardant filler particles such as particles of ethylenebis(tetrabromophthalimide), octabromodiphenyl oxide, decabromodiphenyl oxide, and ethylenebisdibromonorbornane dicarboximide.

As present in the microporous material, the finely divided substantially water-insoluble non-siliceous filler particles may be in the form of ultimate particles, aggregates of ultimate particles, or a combination of both. In most cases, at least about 75 percent by weight of the non-silieous filler particles used in preparing the microporous material have gross particle sizes in the range of from about 0.1 to about 40 micrometers as determined by use of a Micromeretics Sedigraph 5000-D (Micromeretics Instrument Corp.) in accordance with the accompanying operating manual. The preferred ranges vary from filler to filler. For example, it is preferred that at least about 75 percent by weight of anitmony oxide particles be in the range of from about 0.1 to about 3 micrometers, whereas it is preferred that at least about 75 percent by weight of barium sulfate particles be in the range of from about 1 to about 25 micrometers. It is expected that the sizes of filler agglomerates may be reduced during processing of the ingredients to prepare the microporous material. Therefore, the distribution of gross particle sizes in the microporous material may be smaller than in the raw non-siliceous filler itself.

The particularly preferred finely divided substantially water-insoluble siliceous filler particles are precipitated silica. Although both are silicas, it is important to distinguish precipitated silica from silica gel inasmuch as these different materials have different properties. Reference in this regard is made to R. K. Iler, *The Chemistry of Silica,* John Wiley & Sons, New York (1979), Library of Congress Catalog No. QD 181.S6144, the entire disclosure of which is incorporate herein by reference. Note especially pages 15–29, 172–176, 218–233, 364–365, 464–465, 554–564, and 578–579. Silica gel is usually produced commercially at low pH by acidifying an aqueous solution of a soluble metal silicate, typically sodium silicate, with acid. The acid employed is generally a strong mineral acid such as sulfuric acid or hydrochloric acid although carbon dioxide is sometimes used. Inasmuch as there is essentially no difference in density between the gel phase and the surrounding liquid phase while the viscosity is low, the gel phase does not settle out, that is to say, it does not precipitate. Silica gel, then, may be described as a non-precipitated, coherent, rigid, three-dimensional network of contiguous particles of colloidal amorphous silica. The state of subdivision ranges from large, solid masses to submicroscopic particles, and the degree of hydration from almost anhydrous silica to soft gelatinous masses containing on the order of 100 parts of water per part of silica by weight, although the highly hydrated forms are only rarely used in the present invention.

Precipitated silica is usually produced commercially by combining an aqueous solution of a soluble metal silicte, ordinarily alkali metal siliate such as sodium silicate, and an acid so that colloidal particles will grow in weakly alkaline solution and be coagulated by the alkali metal ions of the resulting soluble alkali metal salt. Various acids may be used, including the mineral acids and carbon dioxide. In the absence of a coagulant, silica is not precipitated from solution at any pH. The coagulant used to effect precipitation may be the soluble alkali metal salt produced during formation of the colloidal silica particles, it may be added electrolyte such as a soluble inorganic or organic salt, or it may be a combination of both.

Precipitated silica, then, may be described as precipitated aggregates of ultimate particles of colloidal amorphous silica that have not at any point existed as macroscopic gel during the preparation. The sizes of the aggregates and the degree of hydration may vary widely.

Precipitated silica powders differ from silica gels that have been pulverized in ordinarily having a more open structure, that is, a higher specific pore volume. However, the specific surface area of precipitated silica as measured by the Brunauer, Emmet, Teller (BET) method using nitrogen as the adsorbate, is often lower than that of silica gel.

Many different precipitated silicas may be employed in the present invention, but the preferred precipitated silicas are those obtained by precipitateion from an aqueous solution of sodium silicate using a suitable acid such as sulfuric acid, hydrochloric acid, or carbon dioxide. Such precipitated silicas are themselves known and processes for producing them are described in detail in U.S. Pat. No. 2,940,830 and in U.S. Pat. No. 4,681,750, the entire disclosures of which are incorporated herein by reference, including especially the processes for making precipitated silicas and the properties of the products.

In the case of the preferred filler, precipitated silica, the average ultimate particle size (irrespective of whether or not the ultimate particles are agglomerated) is less than about 0.1 micrometer as determined by transmission electron microscopy. Often the average ultimate particle size is less than about 0.05 micrometer.

Preferably the average ultimate particle size of the precipitated silica is less than about 0.03 micrometer.

The finely divided substantially water-insoluble filler particles constitute from about 50 to 90 percent by weight of the microporous material. Frequently such filler particles constitute from about 50 to about 85 percent by weight of the microporous material. From about 60 percent to about 80 percent by weight is preferred.

At least about 50 percent by weight of the finely divided substantially water-insoluble filler particles are finely divided substantially water-insoluble siliceous filler particles. In many cases at least about 65 percent by weigh of the finely divided substantially water-insoluble filler particles are siliceous. Often at least about 75 percent by weight of the finely divided substantially water-insoluble filler particles are siliceous. Frequently at least about 85 percent by weight of the finely divided substantially water-insoluble filler particles are siliceous. In many instances all of the finely divided substantially water-insoluble filler particles are siliceous.

Minor amounts, usually less than about 5 percent by weight, of other materials used in processing such as lubricant, processing plasticizer, organic extraction liquid, surfactant, water, and the like, may optionally also be present. Yet other materials introduced for particular purposes may optionally be present in the microporous material in small amounts, usually less than about 15 percent by weight. Examples of such materials include antioxidants, ultraviolet light absorbers, reinforcing fibers such as chopped glass fiber strand, dyes, pigments, and the like. The balance of the microporous material, exclusive of filler and any coating or impregnant applied for one or more special purposes is essentially the thermoplastic organic polymer.

On a coating-free and impregnant-free basis, pores constitute at least about 35 percent by volume of the microporous material. In many instances the pores constitute at least about 60 percent by volume of the microporous material. Often the pores constitute from at least about 35 percent to about 95 percent by volume of the microporous material. From about 60 percent to about 75 percent by volume is preferred. As used herein and in the claims, the porosity (also known as void volume) of the microporous material, expressed as percent by volume, is determined according to the equation:

$$\text{Porosity} = 100[1 - d_1/d_2]$$

where $d_1$ is the density of the sample which is determined from the sample weight and the sample volume as ascertained from measurements of the sample dimensions and $d_2$ is the density of the solid portion of the sample which is determined from the sample weight and the volume of the solid portion of the sample. The volume of the solid portion of the same is determined using a Quantachrome stereopycnometer (Quantachrome Corp.) in accordance with the accompanying operating manual.

The volume average diameter of the pores of the microporous material is determined by mercury porosimetry using an Autoscan mercury porosimeter (Quantachrome Corp.) in accordance with the accompanying operating manual. The volume average pore radius for a single scan is automatically determined by the porosimeter. In operating the porosimeter, a scan is made in the high pressure range (from about 138 kilopascals absolute to about 227 megapascals absolute). If about 2 percent or less of the total intruded volume occurs at the low end (from about 138 to about 250 kilopascals absolute) of the high pressure range, the volume average pore diameter is taken as twice the volume average pore radius determined by the porosimeter. Otherwise, an additional scan is made in the low pressure range (from about 7 to about 165 kilopascals absolute) and the volume average pore diameter is calculated according to the equation:

$$d = 2\left(\frac{v_1 r_1}{w_1} + \frac{v_2 r_2}{w_2}\right) \Big/ \left(\frac{v_1}{w_1} + \frac{v_2}{w_2}\right)$$

where d is the volume average pore diameter, $v_1$ is the total volume of mercury intruded in the high pressure range, $v_2$ is the total volume of mercury intruded in the low pressure range, $r_1$ is the volume average pore radius determined from the high pressure scan, $r_2$ is the volume average pore radius determined from the low pressure scan, $w_1$ is the weight of the sample subjected to the high pressure scan, and $w_2$ is the weight of the sample subjected to the low pressure scan. Generally the volume average diameter of the pores is in the range of from about 0.02 to about 50 micrometers. Very often the volume average diameter of the pores is in the range of from about 0.04 to about 40 micrometers. From about 0.05 to about 30 micrometers is preferred.

In the course of determining the volume average pore diameter by the above procedure, the maximum pore radius detected is sometimes noted. This is taken from the low pressure range scan if run; otherwise it is taken from the high pressure range scan. The maximum pore diameter is twice the maximum pore radius.

Microporous material may be produced according to the general principles and procedures of U.S. Pat. No. 3,351,495, the entire disclosure of which is incorporated herein by reference, including especially the processes for making microporous materials and the properties of the products.

Preferably filler particles, thermoplastic organic polymer powder, processing plasticizer and minor amounts of lubricant and antioxidant are mixed until a substantially uniform mixture is obtained. The weight ratio of filler to polymer powder employed in forming the mixture is essentially the same as that of the microporous material to be produced. The mixture, together with additional processing plasticizer, is introduced to the heated barrel of a screw extruder. Attached to the extruder is a sheeting die. A continuous sheet formed by the die is forwarded without drawing to a pair of heated calender rolls acting cooperatively to form continuous sheet of lesser thickness than the continuous sheet exiting from the die. The continuous sheet from the calender then passes to a first extraction zone where the processing plasticizer is substantially removed by extraction with an organic liquid which is a good solvent for the processing plasticizer, a poor solvent for the organic polymer, and more volatile than the processing plasticizer. Usually, but not necessarily, both the processing plasticizer and the organic extraction liquid are substantially immiscible with water. The continuous sheet then passes to a second extraction zone where the residual organic extraction liquid is substantially removed by steam and/or water. The continuous sheet is then passed through a forced air dryer for substantial removal of residual water and remaining residual organic extraction liquid. From the dryer the continuous sheet, which is microporous material, is passed to a take-up roll.

The processing plasticizer has little solvating effect on the thermoplastic organic polymer at 60° C., only a moderate solvating effect at elevated temperatures on the order of about 100° C., and a significant solvating effect at elevated temperatures on the order of about 200° C. It is a liquid at room temperature and usually it is processing oil such as paraffinic oil, naphthenic oil, or aromatic oil. Suitable processing oils include those meeting the requirements of ASTM D 2226-82, Types 103 and 104. Preferred are those oils which have a pour point of less than 22° C. according to ASTM D 97-66 (reapproved 1978). Particularly preferred are oils having a pour point of less than 10° C. Examples of suitable oils include Shellflex® 412 and Shellflex® 371 oil (Shell Oil Co.) which are solvent refined and hydrotreated oils derived from naphthenic crude. ASTM D 2226-82 and ASTM D 97-66 (reapproved 1978) are, in their entireties, incorporated herein by reference. It is expected that other materials, including the phthalate ester plasticizers such as dibutyl phthalate, bis(2-ethylhexyl) phthalate, diisodecyl phthalate, dicyclohexyl phthalate, butyl benzyl phthalate, and ditridecyl phthalate will function satisfactorily as processing plasticizers.

There are many organic extraction liquids that can be used. Examples of suitable organic extraction liquids include 1,1,2-trichloroethylene, perchloroethylene, 1,2-dichloroethane, 1,1,1-trichloroethane, 1,1,2-trichloroethane, methylene chloride, chloroform, 1,1,2-trichloro-1,2,2-trifluoroethane, isopropyl alcohol, diethyl ether, and acetone.

In the above described process for producing microporous material, extrusion and calendering are facilitated when the substantially water-insoluble filler particles carry much of the processing plasticizer. The capacity of the filler particles to absorb and hold the processing plasticizer is a function of the surface area of the filler. It is therefore preferred that the filler have a high surface area. High surface area fillers are materials of very small particle size, materials having a high degree of porosity or materials exhibiting both characteristics. Usually the surface area of at least the siliceous filler particles is in the range of from about 20 to about 400 square meters per gram as determined by the Brunauer, Emmett, Teller (BET) method according to ASTM C 819-77 using nitrogen as the adsorbate but modified by outgassing the system and the sample for one hour at 130° C. Preferably the surface area is in the range of from about 25 to 350 square meters per gram. ASTM C 819-77 is, in its entirety, incorporated herein by reference. Preferably, but not necessarily, the surface area of any non-siliceous filler particles used is also in at least one of these ranges.

Inasmuch as it is desirable to essentially retain the filler in the microporous material, it is preferred that the substantially water-insoluble filler particles be substantially insoluble in the processing plasticizer and substantially insoluble in the organic extraction liquid when microporous material is produced by the above process.

The residual processing plasticizer content is usually less than 5 percent by weight of the microporous sheet and this may be reduced even further by additional extractions using the same or a different organic extraction liquid.

Pores constitute from about 35 to about 80 percent by volume of the microporous material when made by the above-described process. In many cases the pores constitute from about 60 to about 75 percent by volume of the microporous material.

The volume average diameter of the pores of the microporous material when made by the above-described process, is usually in the range of from about 0.02 to about 0.5 micrometers. Frequently the average diameter of the pores is in the range of from about 0.04 to about 0.3 micrometers. From about 0.05 to about 0.25 micrometers is preferred.

Microporous material may also be produced according to the general principles and procedures of U.S. Pat. Nos. 2,772,322; 3,696,061; and/or 3,862,030, the entire disclosures of which are incorporated herein by reference, including especially the processes for making microporous materials and the properties of the products. These principles and procedures are particularly applicable where the polymer of the matrix is or is predominately poly(vinyl chloride) or a copolymer containing a large proportion of polymerized vinyl chloride.

The microporous material produced by the above-described processes may be used for producing pressure-sensitive multi-part record units of the present invention. However, many of them may optionally be stretched and the stretched microporous material used for producing such record units. When such stretching is employed, the products of the above-described processes may be regarded as intermediate products.

It will be appreciated that the stretching both increases the void volume of the material and induces regions of molecular orientation. As is well known in the art, many of the physical properties of molecularly oriented thermoplastic organic polymer, including tensile strength, tensile modulus, Young's modulus, and others, differ considerably from those of the corresponding thermoplastic organic polymer having little or no molecular orientation.

Stretched microporous material may be produced by stretching the intermediate product in at least one stretching direction above the elastic limit. Usually the stretch ratio is at least about 1.5. In many cases the stretch ratio is at least about 1.7. Preferably it is at least about 2. Frequently the stretch ratio is in the range of from about 1.5 to about 15. Often the stretch ratio is in the range of from about 1.7 to about 10. Preferably the stretch ratio is in the range of from about 2 to about 6. As used herein, the stretch ratio is determined by the formula:

$$S=L_2/L_1$$

where S is the stretch ratio, $L_1$ is the distance between two reference points located on the intermediate product and on a line parallel to the stretching direction, and $L_2$ is the distance between the same two reference points located on the stretched microporous material.

The temperatures at which stretching is accomplished may vary widely. Stretching may be accomplished at about ambient room temperature, but usually elevated temperatures are employed. The intermediate product may be heated by any of a wide variety of techniques prior to, during, and/or after stretching. Examples of these techniques include radiative heating such as that provided by electrically heated or gas fired infrared heaters, convective heating such as that provided by recirculating hot air, and conductive heating such as that provided by contact with heated rolls. The temperatures which are measured for temperature control purposes may vary according to the apparatus used and personal preference. For example, temperature-measuring devices may be placed to ascertain the temperatures of the surfaces of infrared heaters, the interiors of infrared heaters, the air temperatures of points between the infrared heaters and the intermediate product, the temperatures of circulating hot air at points within the apparatus, the temperature of hot air entering or leaving the apparatus, the temperatures of the surfaces of rolls used in the stretching process, the temperature of heat transfer fluid entering or leaving such rolls, or film surface temperatures. In general, the temperature or temperatures are controlled such that the intermediate product is stretched about evenly so that the variations, if any, in film thickness of the stretched microporous material are within acceptable limits and so that the amount of stretched microporous material outside of those limits is acceptably low. It will be apparent that the temperatures used for control purposes may or may not be close to those of the intermediate product itself since they depend upon the nature of the apparatus used, the locations of the temperature-measuring devices, and the identities of the substances or objects whose temperatures are being measured.

In view of the locations of the heating devices and the line speeds usually employed during stretching, gradients of varying temperatures may or may not be present through the thickness of the intermediate product. Also because of such line speeds, it is impracticable to measure these temperature gradients. The presence of gradients of varying temperatures, when they occur, makes it unreasonable to refer to a singular film temperature. Accordingly, film surface temperatures, which can be measured, are best used for characterizing the thermal condition of the intermediate product. These are ordinarily about the same across the width of the intermediate product during stretching although they may be intentionally varied, as for example, to compensate for intermediate product having a wedge-shaped cross-section across the sheet. Film surface temperatures along the length of the sheet may be about the same or they may be different during stretching.

The film surface temperatures at which stretching is accomplished may vary widely, but in general they are such that the intermediate product is stretched about evenly, as explained above. In most cases, the film surface temperatures during stretching are in the range of from about 20° C. to about 220° C. Often such temperatures are in the range of from about 50° C. to about 200° C. From about 75° C. to about 180° C. is preferred.

Stretching may be accomplished in a single step or a plurality of steps as desired. For example, when the intermediate product is to be stretched in a single direction (uniaxial stretching), the stretching may be accomplished by a single stretching step or a sequence of stretching steps until the desired final stretch ratio is attained. Similarly, when the intermediate product is to be stretched in two directions (biaxial stretching), the stretching can be conducted by a single biaxial stretching step or a sequence of biaxial stretching steps until the desired final stretch ratios are attained. Biaxial stretching may also be accomplished by a sequence of one of more uniaxial stretching steps in one direction and one or more uniaxial stretching steps in another direction. Biaxial stretching steps where the intermediate product is stretched simultaneously in two directions and uniaxial stretching steps may be conducted in sequence in any order. Stretching in more than two directions is within contemplation. It may be seen that the various permutations of steps are quite numerous. Other steps, such as cooling, heating, sintering, annealing, reeling, unreeling, and the like, may optionally be included in the overall process as desired.

Various types of stretching apparatus are well known and may be used to accomplish stretching of the intermediate product. Uniaxial stretching is usually accomplished by stretching between two rollers wherein the second or downstream roller rotates at a greater peripheral speed than the first or upstream roller. Uniaxial stretching can also be accomplished on a standard tentering machine. Biaxial stretching may be accomplished by simultaneously stretching in two different directions on a tentering machine. More commonly, however, biaxial stretching is accomplished by first uniaxially stretching between two differentially rotating rollers as described above, followed by either uniaxially stretching in a different direction using a tenter machine or by biaxially stretching using a tenter machine. The most common type of biaxial stretching is where the two stretching directions are approximately at right angles to each other. In most cases where continuous sheet is being stretched, one stretching direction is at least approximately parallel to the long axis of the sheet (machine direction) and the other stretching direction is at least approximately perpendicular to the machine direction and is in the plane of the sheet (transverse direction).

After stretching has been accomplished, the microporous material may optionally be sintered, annealed, heat set and/or otherwise heat treated. During these optional steps, the stretched microporous material is usually held under tension so that it will not markedly shrink at the elevated temperatures employed, although some relaxation amounting to a small fraction of the maximum stretch ratio is frequently permitted.

Following stretching and any heat treatments employed, tension is released from the stretched microporous material after the microporous material has been brought to a temperature at which, except for a small amount of elastic recovery amounting to a small fraction of the stretch ratio, it is essentially dimensionally stable in the absence of tension. Elastic recovery under these conditions usually does not amount to more than about 10 percent of the stretch ratio.

The stretched microporous material may then be further processed as desired. Examples of such further processing steps include reeling, cutting, stacking, treatment to remove residual processing plasticizer or extraction solvent, coating or impregnation with various materials, and fabrication into shapes for various end uses.

Stretching is preferably accomplished after substantial removal of the processing plasticizer as described above. For purposes of this invention, however, the calendered sheet may be stretched in at least on stretching direction followed by substantial removal of the residual organic extraction liquid. It will be appreciated that as stretching may be accomplished in a single step or a plurality of steps, so likewise extraction of the processing plasticizer may be accomplished in a single step or a plurality of steps and removal of the residual organic extraction liquid may be accomplished in a single step or a plurality of steps. The various combinations of the steps stretching, partial stretching, processing plasticizer extraction, partial plasticizer extraction, removal of organic extraction liquid, and partial removal of organic extraction liquid are very numerous, and may be accomplished in any order, provided of course, that a step of processing plasticizer extraction (partial or substantially complete) precedes the first step of residual organic extraction liquid removal (partial or substantially complete). It is expected that varying the orders and numbers of these steps will produce variations in a least some of the physical properties of the stretched microporous product.

In all cases, the porosity of the stretched microporous material is, unless coated or impregnated after stretching, greater than that of the intermediate product. On a coating-free and impregnant-free basis, pores usually constitute more than 80 percent by volume of the stretched microporous material. In many instances the pores constitute at least about 85 percent by volume of the stretched microporous material. Often the pores constitute from more than 80 percent to about 95 percent by volume of the stretched microporous material. From about 85 percent to about 95 percent by volume is preferred.

Generally the volume average diameter of the pores of the stretched microporous material is in the range of from 0.6 to about 50 micrometers. Very often the volume average diameter of the pores is in the range of from about 1 to about 40 micrometers. From about 2 to about 30 micrometers is preferred.

The microporous material, whether or not stretched, may be printed with a wide variety of printing inks using a wide variety of printing processes. Both the printing inks and the printing processes are themselves conventional. Printing may be accomplished before assembly of the microporous material into record units of the present invention as is preferred, or in some cases after assembly of such record units.

There are many advantages in using the microporous material described herein as a printing substrate.

One such advantage is that the substrate need not be pretreated with any of the pretreatments customarily used to improve adhesion between the printing ink and the substrate such as flame treatment, chlorination, or especially corona discharge treatment which is most commonly employed. This is particularly surprising in the case of polyolefins inasmuch as untreated polyolefins such as polyethylene and polypropylene cannot ordinarily be successfully printed because of a lack of adhesion between the printing ink and the polyolefin substrate. The microporous material substrates used in the present invention may be pretreated to further improve ink-substrate adhesion, but commercially satisfactory results can ordinarily be attained without employing such methods.

Another advantage is that the microporous material substrates accept a wide variety of printing inks, including most organic solvent-based inks which are incompatible with water, organic solvent-based inks which are compatible with water, and water-based inks.

Yet another advantage is very rapid drying of most inks to the tack-free state upon printing the microporous material substrates. This advantage is quite important in high speed press runs, in multicolor printing, and in reducing or even eliminating blocking of stacks or coils of the printed substrate.

A further advantage is the sharpness of the printed image that can be attained. This is especially important in graphic arts applications where fine lines, detailed drawings, or halftone images are to be printed. Halftone images printed on the microporous material substrates ordinarily exhibit high degrees of dot resolution.

Ink jet printing, especially when a water-based ink jet printing ink is used, is particularly suitable for printing bar codes on microporous material substrates. The resulting bars are sharp and of high resolution, which are important factors in reducing errors when the codes are read by conventional methods and equipment. The ink dries very rapidly when applied, thereby minimizing loss of bar resolution due to smearing in subsequent handling operations.

Printing processes, printing equipment, and printing inks have been extensively discussed and documented. Examples of reference works that may be consulted include L. M. Larsen, *Industrial Printing Ink,* Reinhold Publishing Corp., (1962); Kirk-Othmer, *Encyclopedia of Chemical Technology,* 2d Ed., John Wiley & Sons, Inc., Vol. 11, pages 611–632 (1966) and Vol. 16, pages 494–456 (1968); and R. N. Blair, *The Lithographers Manual,* The Graphic Arts Technical Foundation, Inc., 7th Ed. (1983).

For a more detailed description of printing on microporous material of the kind employed in the present invention, see U.S. Pat. No. 4,861,644, which is a continuation-in-part of Application Ser. No. 42,404, filed Apr. 24, 1987, the entire disclosures of which are incorporated herein by reference.

When desired the microporous material may be bonded to one or more other materials which may be porous or nonporous. In some instances it may be desirable to bond the microporous material to a reinforcing substrate, but usually this is not necessary. More commonly the microporous material is bonded at a margin to the adjacent sheet(s) of the assembled record unit.

Bonding may be made by conventional techniques such as for example fusion bonding and adhesive bonding. Examples of fusion bonding include sealing through use of heated rollers, heated bars, heated plates, heated bands, heated wires, flame bonding, radio frequency (RF) sealing, and ultrasonic sealing. Heat sealing is preferred. Solvent bonding may be used where the polymer of the microporous material and/or polymer of the other layer or sheet is soluble in the applied solvent at least to the extent that the polymer becomes tacky. After the microporous material has been brought into contact with the other layer or sheet, the solvent is removed to form a fusion bond.

Many adhesives which are well known may be used to accomplish bonding. Examples of suitable classes of adhesives include thermosetting adhesives, thermoplastic adhesive, adhesives which form the bond by solvent evaporation, adhesives which form the bond by evaporation of liquid nonsolvent, and pressure sensitive adhesives.

The thickness across the microporous material may vary widely, but usually it is in the range of from about 0.03 to about 4 millimeters. In many cases it is in the range of from about 0.07 to about 1.5 millimeters. From about 0.18 to about 0.6 millimeter is preferred.

Although not necessary, the microporous material of the receptor sheet may be partially coated or partially impregnated with various materials for various purposes. The coating or impregnation, when used, should be applied such that at least some of the siliceous particles of the front side of the receptor sheet remain available for reaction with the leuco dye of the transfer sheet upon the application of pressure. The material used for partial coating or partial impregnation may, when desired, comprise substances which react upon contact with the leuco dye to form a color. Examples of such substances include phenolic materials such as 2-ethylhexylgallate, 3,5-di-tert-butyl salicylic acid, phenolic resins of the novolak type and metal modified phenolic materials such as the zinc salt of 3,5-di-tert-butyl salicylic acid and the zinc modified novolak type resins. See for example U.S. Pat. Nos. 4,025,490 and 4,091,122, the entire disclosures of which are incorporated herein by reference.

Transfer sheets which may be used in the record units of the present invention are well known, as are the leuco dyes, CB coatings, pressure-rupturable coatings, pressure-rupturable microcapsules, processes for making such materials, and processes for collating transfer sheets, transfer-receptor sheets and receptor sheets into record units. See for example the following U.S. patents, the entire disclosures of which are incorporated herein by reference:

| | | | |
|---|---|---|---|
| Re23,024 | 2,550,472 | 3,875,074 | 4,508,807 |
| Re24,899 | 2,550,473 | 3,914,511 | 4,532,200 |
| Re31,412 | 2,712,507 | 4,001,140 | 4,551,407 |
| 2,068,204 | | 4,025,455 | 4,562,137 |
| 2,299,694 | 2,730,456 | 4,087,376 | |
| 2,374,862 | 2,730,457 | 4,089,802 | |
| 2,505,470 | 2,800,457 | 4,091,122 | |
| 2,505,472 | 2,800,458 | 4,097,619 | |
| 2,505,480 | 2,828,341 | 4,112,138 | |
| 2,548,364 | 2,828,342 | 4,137,084 | |
| 2,548,365 | 2,981,733 | 4,154,462 | |
| 2,550,466 | 2,981,738 | 4,203,619 | |
| 2,550,467 | 3,455,721 | 4,264,365 | |
| 2,550,468 | 3,466,184 | 4,268,069 | |
| 2,550,469 | 3,672,935 | 4,336,067 | |
| 2,550,470 | 3,755,190 | 4,398,954 | |
| 2,550,471 | 3,796,669 | 4,399,209 | |

and see also *Encyclopedia of Polymer Science and Engineering,* Volume 9, John Wiley & Sons, Inc., pages 724–745 (1987), the entire disclosure of which is incorporated herein by reference.

The liquid droplets of the pressure-rupturable coating and the liquid contained by the microcapsules may contain one or more than one leuco dye which, when brought into contact with the siliceous particles, forms a color. The liquid may also contain other substances, such as rheology modifying agents, dyes, and/or leuco dyes which form colors by mechanisms other than by mere contact with the siliceous particles, oxidation being an example of such a mechanism.

The leuco dyes which form colors upon contact with the siliceous particles are preferably substantially colorless, though light tones may be tolerated. Upon contact with the siliceous particles the color formed is preferably strong and distinctive. Such leuco dyes are usually chromogenic color precursors of the electron-donor type. Examples of such materials include the lactone phthalides such as crystal violet lactone [CAS Registry No. 1552-42-7], malachite green lactone, 3,3-bis(1'-ethyl-2-methylindol-3'-yl) phthalide, the lactone fluorans, such as 2-dibenzylamino-6-diethylaminofluoran and 6-diethylamino-1,3-dimethylfluorans, the lactone xanthenes, the leucoauramines, the 2-(omega substituted vinylene)-3,3-disubstituted-3H-indoles, and the 1,3,3-trialkylindolinospirans.

Because the colors formed by the leuco dyes upon contact with the siliceous particles often tend to fade in the course of time, it is preferred that an oxidizing substantially colorless compound, such as for example benzoyl leuco methylene blue [CAS Registry No. 1249-97-4], be included in the liquid. Such oxidizing compounds ordinarily change to the colored form over a period of several hours or days and support the fading substantially instantly-produced color so that the marks produced on the receptor sheet are permanent.

The preferred combination of leuco dyes which form colors by different mechanisms is that of crystal violet lacone and benzoyl leuco methylene blue.

The solvent in which the leuco dye is dissolved, is usually an oil conventionally used in carbonless paper manufacture or a radiation curable monomer in which the leuco dye is soluble. Examples include alkylated biphenyls, polychlorinated biphenyls, castor oil, mineral oils, deodorized kerosene, naphthenic mineral oil, dibutyl phthalate, dibutyl fumarate, brominated paraffin and mixtures thereof.

The amount of leuco dye present in the liquid solution may vary widely. In most cases, the concentration of the leuco dye in the solution is in the range of from about 0.5 percent to about 20 percent by weight. Preferably the concentration is in the range of from about 2 percent to about 7 percent by weight.

The invention is further described in conjunction with the following examples which are to be considered illustrative rather than limiting, and in which all parts are parts by weight and all percentages are percentages by weight unless otherwise specified.

EXAMPLE I

The preparation of the above described receptor sheets is illustrated by the following descriptive example. Processing oil was used as the processing plasticizer. Silica, polymer, lubricant and antioxidant in the amount specified in Table I were placed in a high intensity mixer and mixed at high speed for 6 minutes. The processing oil needed to formulate the batch was pumped into the mixer over a period of 12–18 minutes with high speed agitation. After completion of the processing oil addition a 6 minute high speed mix period was used to distribute the processing oil uniformly throughout the mixture.

TABLE I

| Formulations | |
|---|---|
| UHMWPE (1), kg | 17.24 |
| HDPE (2), kg | 6.80 |
| Precipitated Silica (3), kg | 59.87 |
| Lubricant (4), g | 600.0 |
| Antioxidant (5), g | 100.0 |
| Processing Oil (6), kg | |
| in Batch | 91.63 |
| at Extruder | ~35.14 |

(1) UHMWPE = Ultrahigh Molecular Weight Polyethylene, Himont 1900, Himont, U.S.A., Inc.
(2) HDPE = High Density Polyethylene, Hostalen ® GM 6255, Hoechst Celanese Corp.
(3) HiSil ® SBG, PPG Industries, Inc.
(4) Petrac ® CZ81, Desoto, Inc., Chemical Speciality Division
(5) Irganox ® 1010, Ciba-Geigy Corp.
(6) Shellflex ® 371, Shell Chemical Co.

The batch was then conveyed to a ribbon blender where usually it was mixed with up to two additional batches of the same composition. Material was fed from the ribbon blender to a twin screw extruder by a variable rate screw feeder. Additional processing oil was added via a metering pump into the feed throat of the extruder. The extruder mixed and melted the formulation and extruded it through a 76.2 centimeter ×0.3175 centimeter slot die. The extruded sheet was then calendered. A description of one type of calender that may be used may be found in the U.S. Pat. No. 4,734,229, the entire disclosure of which is incorporated herein by reference, including the structures of the devices and their modes of operation. Other calenders of different design may alternatively be used; such calenders and their modes of operation are well known in the art. The hot, calendered sheet was then passed around a chill roll to cool the sheet. The rough edges of the cooled calendered sheet were trimmed by rotary knives to the desired width.

The oil filled sheet was conveyed to the extractor unit where it was contacted by both liquid and vaporized 1,1,2-trichloroethylene (TCE). The sheet was transported over a series of rollers in a serpentine fashion to provide multiple, sequential vapor/liquid/vapor contacts. The extraction liquid in the sump was maintained at a temperature of 65°–88° C. Overflow from the sump of the TCE extractor was returned to a still which recovered the TCE and the processing oil for reuse in the process. The bulk of the TCE was extracted from the sheet by steam as the sheet was passed through a second extractor unit. A description of these types of extractors may be found in U.S. Pat. No. 4,648,417, the entire disclosure of which is incorporated herein by reference, including especially the structures of the devices and their modes of operation. The sheet was dried by radiant heat and convective air flow. The dried sheet was wound on cores to provide roll stock for further processing.

The microporous sheet was tested for various physical properties. The results are shown in Table II where the methods used for determination of Breaking Factor and Elongation at Break were in accordance with ASTM D 882-83 which, in its entirety, is incorporated herein by reference.

Property values indicated by MD (machine direction) were obtained on samples whose major axis was oriented along the length of the sheet. TD (transverse direction; cross machine direction) properties were obtained from samples whose major axis was oriented across the sheet.

TABLE II

| Physical Properties of Microporous Sheet | |
|---|---|
| Thickness, mm | 0.255 |
| Breaking Factor, kN/m | |
| MD | 3.23 |
| TD | 1.52 |
| Elongation at break, % | |
| MD | 688 |
| TD | 704 |
| Processing Oil Content, wt % | 3.1 |

EXAMPLE II

A CB sheet was removed from a package of Mead Paper Trans/rite® carbonless paper, CB-15 White, and superimposed on a sample of the microporous material produced in Example I. The CB coating of the CB sheet comprised microcapsules containing leuco dye dissolved in solvent and was adjacent the microporous material. With the resulting assembly in place, a ball point pen was used to write on the front side of the CB sheet. The assembly was then placed in an IBM Selectric® typewriter with the front side of the CB sheet facing the typing ball. Typing was performed in the normal manner. Upon separation of the sheets, it was observed that easily readable blue images corresponding to what was written and typed were present on the front side of the microporous material.

Although the present invention has been described with reference to specific details of certain embodiments thereof, it is not intended that such details should be regarded as limitations upon the scope of the invention except insofar as they are included in the accompanying claims.

What is claimed is:

1. In a pressure-sensitive multi-part record unit comprising:

(a) at least one transfer sheet having a front side and a back side, said back side comprising:

(1) a pressure-rupturable coating having entrapped therein a profuse number of minute liquid droplets comprising at least one leuco dye dissolved in solvent, (2) pressure-rupturable microcapsules containing at least one leuco dye dissolved in solvent, or (3) a combination thereof, wherein the leuco dye is reactive with finely divided, substantially water-insoluble siliceous particles upon contact therewith to form a color, and (b) at least one receptor sheet having a front side and a back side, said front side of said receptor sheet comprising said siliceous particles, the improvement wherein said front side of said receptor sheet comprises microporous material comprising:

(c) a matrix consisting essentially of substantially water-insoluble thermoplastic organic polymer, (d) finely divided substantially water-insoluble filler particles, of which at least about 50 percent by weight are siliceous particles with which said leuco dye is reactive upon contact to form a color, said filler particles being distributed throughout said matrix and constituting from about 50 percent to about 90 percent by weight of said microporous material, and (e) a network of interconnecting pores communicating substantially throughout said microporous material, said pores on a coating-free and impregnant-free basis constituting at least about 35 percent by volume of said microporous material.

2. The pressure-sensitive multi-part record unit of claim 1 wherein said substantially water-insoluble thermoplastic organic polymer comprises essentially linear ultrahigh molecular weight polyolefin which is essentially linear ultrahigh molecular weight polyethylene having an intrinsic viscosity of at least about 18 deciliters/gram, essentially linear ultrahigh molecular weight polypropylene having an intrinsic viscosity of at least about 6 deciliters/gram, or a mixture thereof.

3. The pressure-sensitive multi-part record unit of claim 2 wherein said essentially linear ultrahigh molecular weight polyolefin is essentially linear ultrahigh molecular weight polyethylene having an intrinsic viscosity of at least about 18 deciliters/gram.

4. The pressure-sensitive multi-part record unit of claim 3 wherein said pores on a coating-free and impregnant-free basis constitute at least about 60 percent by volume of said microporous material.

5. The pressure-sensitive multi-part record unit of claim 3 wherein said ultrahigh molecular weight polyethylene has an intrinsic viscosity in the range of from about 18 to about 39 deciliters/gram.

6. The pressure-sensitive multi-part record unit of claim 3 wherein said siliceous particles of said microporous material constitute from about 50 percent to about 85 percent by weight of said microporous material.

7. The pressure-sensitive multi-part record unit of claim 3 wherein said siliceous particles of said microporous material are silica.

8. The pressure-sensitive multi-part record unit of claim 3 wherein said siliceous particles of said microporous material are precipitated silica particles.

9. The pressure-sensitive multi-part record unit of claim 8 wherein said precipitated silica particles have an average ultimate particle size of less than about 0.1 micrometer.

10. The pressure-sensitive multi-part record unit of claim 3 wherein the volume average diameter of said pores as determined by mercury porosimetry is in the range of from about 0.02 to about 50 micrometers.

11. The pressure-sensitive multi-part record unit of claim 3 wherein the volume average diameter of said pores as determined by mercury porosimetry is in the range of from about 0.02 to about 0.5 micrometers.

12. The pressure-sensitive multi-part record unit of claim 3 wherein high density polyethylene is present in said matrix.

13. The pressure-sensitive multi-part record unit of claim 3 wherein said back side of said transfer sheet comprises said pressure-rupturable microcapsules.

14. The pressure-sensitive multi-part record unit of claim 13 wherein said leuco dye is crystal violet lactone.

15. The pressure-sensitive multi-part record unit of claim 14 wherein said microcapsules also contain benzoyl leuco methylene blue.

16. The pressure-sensitive multi-part record unit of claim 1 wherein said substantially water-insoluble thermoplastic organic polymer comprises poly(vinyl chloride), copolymer of vinyl chloride, or a mixture thereof.

* * * * *